US007430779B1

(12) United States Patent
Garry

(10) Patent No.: US 7,430,779 B1
(45) Date of Patent: Oct. 7, 2008

(54) COMBINATION TOILET BRUSH AND PLUNGER

(76) Inventor: Steven Garry, 2259 E. Glencove St., Mesa, AZ (US) 85213

( * ) Notice: Subject to any disclaimer, the term of this patent is extended or adjusted under 35 U.S.C. 154(b) by 792 days.

(21) Appl. No.: 10/953,250

(22) Filed: Sep. 28, 2004

Related U.S. Application Data

(63) Continuation-in-part of application No. 10/729,693, filed on Dec. 5, 2003, now Pat. No. 7,299,519.

(60) Provisional application No. 60/541,823, filed on Feb. 5, 2004.

(51) Int. Cl.

| | |
|---|---|
| ***A47K 11/00*** | (2006.01) |
| ***A46B 13/08*** | (2006.01) |
| ***A46B 15/00*** | (2006.01) |
| *B08B 9/027* | (2006.01) |

(52) U.S. Cl. ..... 15/104.05; 15/105

(58) Field of Classification Search ..... 15/104.05, 15/105, 160; 4/255.01, 255.11; 206/361
See application file for complete search history.

(56) References Cited

U.S. PATENT DOCUMENTS

| | | | | |
|---|---|---|---|---|
| 1,018,939 | A | 2/1912 | Sterrick | |
| 1,900,275 | A | 9/1933 | Carter et al. | |
| 2,473,452 | A | 6/1949 | Scott | |
| 4,417,364 | A | 11/1983 | Hammond | |
| D274,273 | S | 6/1984 | Auerbach | |
| 5,377,362 | A | 1/1995 | Jackson | |
| 5,423,621 | A | 6/1995 | Russell | |
| 5,617,605 | A | 4/1997 | Hoerner | |
| 7,299,519 | B1 * | 11/2007 | Garry | 15/104.05 |

* cited by examiner

*Primary Examiner*—David B Thomas
(74) *Attorney, Agent, or Firm*—Booth Udall, PLC

(57) ABSTRACT

A tool for both plunging and cleaning plumbing fixtures and drains includes a handle with a plunger and a cleaning brush both connected to the same end of the handle. The plunger is removable by way of a connector between the brush handle and the plunger head. The brush and handle may be released from the plunger head and used for scrubbing and cleaning a toilet bowl. The plunger may be reconnected to the brush and handle, allowing the plunger head to be operated by use of the brush handle. When the plunger, brush and handle are connected, the tool is also in a storage form and may be easily and aesthetically stored. Exemplary embodiments are particularly useful for cleaning and plunging toilets using the combination toilet brush and toilet plunger.

20 Claims, 2 Drawing Sheets

COMBINATION TOILET BRUSH AND PLUNGER

CROSS REFERENCE TO RELATED APPLICATIONS

This application claims priority to U.S. Provisional Patent Application entitled "Combination Toilet Brush and Plunger," Ser. No. 60/541,823, filed Feb. 5, 2004, and is a continuation-in-part of the earlier U.S. patent application to Steven P. Garry entitled "Combination Toilet Plunger and Brush," Ser. No. 10/729,693, filed Dec. 5, 2003, now U.S. Pat. No. 7,299,519, the disclosures of which are hereby incorporated entirely herein by reference.

BACKGROUND OF THE INVENTION

1. Technical Field

This invention generally relates to tools for cleaning plumbing drains and more specifically to a combination toilet plunger and brush tool in which the brush and plunger are coupled to the same handle.

2. State of the Art

Toilet plungers and toilet brushes have been used for many years. Their general structure, methods of manufacture, function and usefulness are well known. A conventional plunger is generally made of some form of resilient rubber material that includes a concave region. When the plunger is pressed against a surface or into an opening, the space of the concave region is depressed and a suction is created as the concave region is moved back to its original shape. Plungers are commonly used for forcing water into and suctioning matter out of drains and other plumbing fixtures. For convenience in manipulating the plunging end of the plunger, toilet plungers include a long, straight, rounded handle rod that the user grasps when moving the plunger up and down.

Conventional toilet brushes include a plurality of flexible bristles extending from a center rod or a bristle surface. The rod or surface is generally coupled to a handle for easy manipulation. The handle for a toilet brush is generally much shorter than the handle of a plunger (⅓ to ⅔ the length). Methods and materials for making and using toilet brushes, like plungers, are well known in the art.

Both toilet brushes and toilet plungers generally come into contact with things found in a toilet and often become covered with toilet paper, excrement, or at least germ-laden toilet water. Unless the user actually uses fingers to pluck the material clinging to the brush or plunger, users generally shake the plunger or brush, or tap the plunger or brush on the side of the toilet to remove the contaminated materials before storage. Each of these movements, however, because of the restricted area available within the toilet bowl, frequently results in the toilet water and related toilet germs splattering outside of the toilet bowl.

Storage of toilet brushes and toilet plungers is conventionally maintained somewhere in the bathroom and is generally very unsightly. Toilet brushes and plungers are generally stored separately, each having an elongated handle that requires tall or wide storage space. In recent years, short plastic cases have been used to enclose and store the bristle portion of the brush on the floor next to the toilet.

Others have created combination brush and plunger tools that are not designed, intended or practical for many uses, including use with a toilet. In United States Design Patent D274,273 to Auerbach (Jun. 12, 1984), Auerbach discloses a design for a garbage disposal thrust plunger and related brush. Different from a toilet plunger which creates suction to draw clogged materials from a drain, however, the plunger of Auerbach is a thrust stick to push items into a garbage disposal with short, rigid bristles on the end for scrubbing the disposal fixtures. The Auerbach tool could not be used to unclog a toilet by suction and is different from most conventional toilet brushes.

U.S. Utility Pat. No. 5,617,605 to Hoerner et al. (Apr. 8, 1997) discloses a sink drain cleaning tool including a cleaning brush and plunger handle at one end, a plunger plate in the middle, and a brush handle at the other end. Apart from the shape of the plunger being designed specifically for a sink shape rather than a toilet shape, it is clear from the positioning of the two handles that the inventor did not contemplate its use for cleaning toilets. Use of this tool requires the user to grasp the brush end of the tool to plunge and the plunger end to brush. It is likely that the user's hand will come in contact with contaminated tool surfaces during use.

It would be advantageous in the cleaning industry to have an attractive combination cleaning and plunging tool to use in cleaning toilets. It would also be advantageous if that tool required less storage space than the two tools separately, and included a convenient way to access the plunger in times of emergency or need. Since the typical use of a toilet brush is more frequent then the use of the plunger, the toilet brush is accessed more frequently. Having both devices readily available, on one tool that can be placed near the toilet, would be useful for both regular cleaning and occasional emergency plunging activities.

DISCLOSURE OF THE INVENTION

Embodiments of the present invention relate to a combination plunging and cleaning tool comprising both a cleaning brush and a plunger on the same, first end of a handle. Specific embodiments relate primarily to the toilet cleaning industry and have plunger and cleaning brush components designed for use in a toilet. The tool's brush is stored inside the plunger base of the tool. This allows for compact tool storage, ease of use, and a hidden brush when the tool is stored. In use, the brush may be extracted from its position in the plunger by uncoupling the brush and its connected handle from the plunger base. Removing the brush from its base then exposes the brush to allow a user to scrub with the brush while leaving the plunger base or head of the device on the floor or ground. For general cleaning with the brush, the tool is therefore lighter and disconnected from the plunger head. The brush can then be stored in the plunger head or reconnected to the plunger for use in the event of a clogged drain.

Additional features used in particular embodiments include a slip-resistant grip on the brush handle to assist in cleaning and in maintaining the relative position of the brush when reconnecting to the plunger head and drain vents to allow fluid to drain from the base and allowing the brush to dry more efficiently. A coupling member extending from the bottom portion of the brush handle that allows the brush to be retained inside the plunger for greater aesthetically pleasing storage, while functionally providing a mechanism to control the plunger.

While embodiments of the present invention may be useful in many cases where both a cleaning or scrubbing brush and a plunger are used, it is expected that the various embodiments are particularly useful as a tool for cleaning and plunging toilets. The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
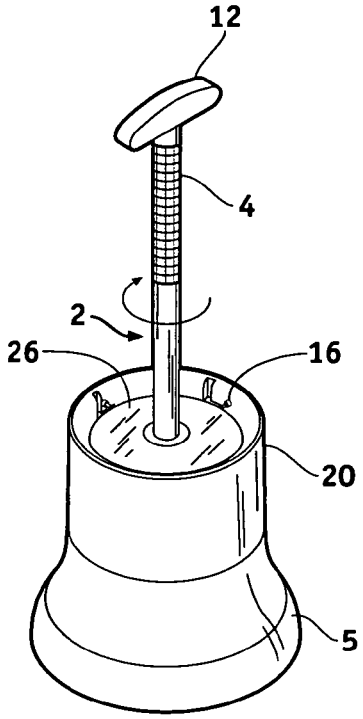
FIG. 1 is a perspective view of a combination plunger and brush according to a particular example embodiment of the present invention.

As discussed above, embodiments of the present invention relate to a combination plunger and brush tool particularly useful in cleaning and plunging toilets.

FIGS. 1-6 illustrate various views of one particular embodiment of a combination toilet plunger and toilet brush configured according to various aspects of the present invention. The combination toilet plunger and brush tool 2 includes a handle 4 having a brush 8 and a plunger base 5 coupled to a first end and a cross-member 12 handle coupled to a second end. The various other elements indicated in the drawings assist in operating the combination tool 2.

The handle 4 of the tool 2 may be formed of any material and using any method conventionally used for forming a cleaning tool handle. Examples of possible materials include, but are not limited to, plastic, wood, rubber, metal, and the like. Because plastic is easy to mold to a desired shape, cleans easily, is lightweight, and inexpensive, it is a particularly useful material for forming many cleaning product parts. However, parts of other materials may alternatively be used, and the particular material used is not crucial to this invention.

The plunger base 5 of the tool 2, like conventional plungers, is made of a resilient material that generally retains its shape, but allows itself to be significantly depressed and manipulated from its initial shape when a force is applied. Specific examples of resilient materials include, but are not limited to, rubber and silicon. Other materials well known in the art of plunger manufacture are suitable for this purpose and may be substituted so long as the plunger has enough shape retention to function as a plunger. It is contemplated that the upper portions of the plunger base 5 may be formed of a first material, such as a hard plastic or rubber to retain the brush 8, while the lower, plunging portions of the plunger base 5 may be formed of material conventional for use in plungers. The precise shape of the plunger base 5 is not crucial to the invention, though the plunger should generally include a hollow portion, which is typically a hollow concave portion, with a substantially continuous surface extending about its opening that can create a suction when depressed against a surface or upon a drain.

As used herein, the term "hollow" is intended to include not only generally curved, rounded or vaulted surfaces, but also other structures that include a hollow portion and an opening so that the structure, made of resilient material, can be collapsed or depressed to a size smaller than its shape-retaining size. Non-limiting examples of hollow shapes include hemispheres, cones, boxes, pyramids, bells, shapes of known plungers, and all other shapes and combinations of linear and nonlinear shapes and structures that include an opening and a recess to allow for collapsing of the shape for plunging and suction. The hollow shape of the plunger base 5 shown in FIGS. 1,2 and 4 includes an opening that is generally a bell-shaped, bottle-shaped or cone-shaped structure with an opening facing away from the handle 4. The plunger base 5 may be molded or formed by methods known in the art for molding or forming the material used to make the plunger base 5. The particular line-shape for the curvature of the plunger base 5 and radius of curvature and point where the curvature occurs is not crucial to the invention. As is explained herein, so long as the plunger base 5 is permitted to stably retain the brush 8 coupled to handle 4 within the plunger base 5 and functions as a plunger, any suitable radius of curvature or point at which the curvature occurs is sufficient for the invention. It is believed that those of ordinary skill in the art of plungers will readily be able to select an appropriate material or combination of materials for the plunger base 5 and mold it or shape it to the appropriate shape and size from the explanation and description provided herein depending upon the particular application for the plunging tool.

Figure 2:
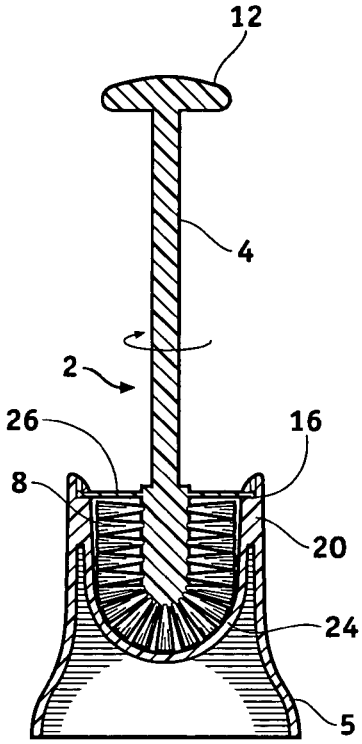
FIG. 2 is a cross-sectional view of a portion of the combination plunger and brush shown in FIG. 1 with the brush interlocked with the plunger head.
Figure 3:
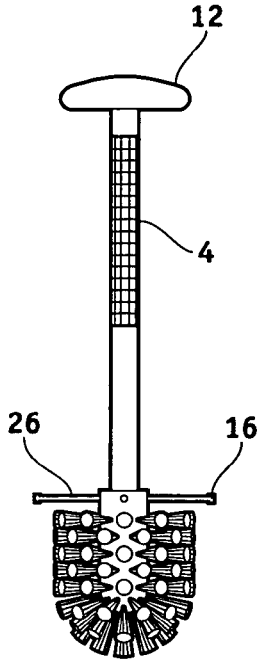
FIG. 3 is a perspective view of the brush and handle of FIG. 1 disconnected from the plunger head base.
Figure 4:
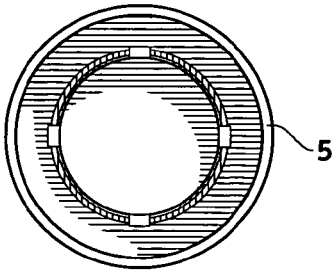
FIG. 4 is a bottom view of the plunger base.

The embodiment of the tool 2 shown in FIGS. 2-3 includes both a brush 8 and a plunger base 5 that are removably coupled together. The brush 8 and handle 4 may be connected to the plunger base 5 by way of an interlocking coupling member 16 extending from the first end of handle 4 and a collar 20 coupled to a top portion of plunger base 5. Coupling member 16 may be a plurality of pegs or posts in corresponding position with embedded groves, notches, or the like used individually or in combination and located on collar 20. For convenience, a cross-member 12 is in place for twisting the handle 4 and brush 8 with the peg or posts in a sideways direction that will allow for the plunger base 5 to be interlocked with the brush handle 4 at the coupling members 16.

The materials through which the brush and brush bristles may be made include all conventional brush-making materials such as nylon, plastic, rubber, coated metal, and the like. It is contemplated that in particular embodiments of the invention, wire bristles may be desirable depending upon the particular application in which the tool will be used. However, in most instances the brush materials will be formed from a resilient, durable material sufficient for scrubbing relatively smooth surfaces such as porcelain, plaster, polished metal, stone, and other surfaces typically found around plumbing drains.

Figure 5:
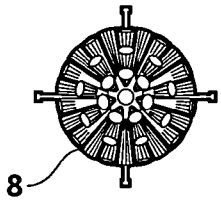
FIG. 5 is a bottom view of the brush of FIG. 1 when out of plunger base.
Figure 6:
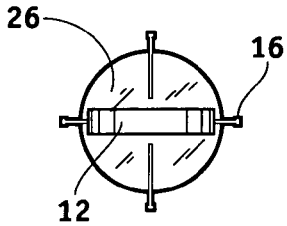
FIG. 6 is a top view of the brush of FIG. 1 when out of plunger base.

Referring to FIGS. 3,5 and 6, the brush 8 may be formed on the end of the handle 4, or attached or otherwise coupled to the handle 4. It is contemplated that the brush 8 may be permanently coupled to the handle 4 or may be removable for replacement when worn or for use with a disposable brush. Twisted wire brushes using nylon or plastic bristles are well known in the art. Another method of forming a brush is to mold nylon or plastic bristles into supporting surfaces. Such a supporting surface could be extended into the plunger base 5.

To make the disconnect of the brush handle 4 from the plunger base 5 occur more easily, brush 8 is preferably short and/or flexible so as to not interfere significantly with the coupling member 16 and the plunger base 5. The resilience or flexibility of the bristles will depend, primarily, upon the density and length of the bristles, the particular tool design selected, and the intended use of the tool. It is believed that those of ordinary skill in the art of cleaning brush manufacture and design will readily be able to select an acceptable combination of materials, size and design from the present disclosure. As can be seen in FIGS. 1-2, the plunger in the brush storage position allows for the bristles to be covered and rest in a cavity 24 made of plastic, rubber, silicon or some other material similar to those used in the plunger base 5 for storage and drying after use.

In particular embodiments of the present invention one or more cross-members 12 and coupling members 16 may be extended in a radial direction from the handle 4 of the tool 2 as seen in FIG. 6. The cross-member 12 serves primarily two functions. First, use of one or more cross-members 12 provides a convenient and comfortable handle for the plunger and brush tool that is more comfortably manipulated by a user of the tool than the straight pole handle typical of conventional plungers and brushes. This is particularly useful when plunging a toilet. Second, inclusions of one or more cross-members 12 allows a user to rapidly and easily spin the tool about its longitudinal axis to cause contaminants and/or excess water to be thrown from the tool due to centripetal force while the plunger of the tool is still within the bowl. This is expected to significantly reduce the splatter caused by shaking a plunger or brush, or tapping it on the side of the bowl. Additionally, the rotational movement of the brush may allow for additional scrubbing action in the bowl if used while cleaning the bowl with the brush. In particular embodiments of the invention, additional coupling members 16 allow for coupling handle 4 to occur with the plunger base 5 by way of twisting, pressure, or some form of movement that causes the coupling area to be connected or disconnected depending on the desired use. While the particular shape and size of both the cross-member 12 and the coupling members 16, and the number of radially extending members is not crucial, it is expected that one cross-member 12 and at least two coupling members 16 forming any of an L, T, Y and X shape will be typical. The size and shape of the cross-member 12 and the coupling members 16 will be determined substantially by the thickness required to withstand the plunging action. In other words, the size selected needs to be thick enough to support average use of the tool 2 as a plunger with handle 4 without breaking the tool too easily.

Referring to FIGS. 1-3 and 6, particular embodiments of the present invention provide a barrier to fluid entry into cavity 24 when plunging, thus reducing the likelihood of retaining unsanitary fluids within cavity 24. This can be done by use of a water-resistant seal and/or cover 26 between the plunger base 5 and the handle 4 near coupling member 16. In particular specific embodiments, a ring seal or gasket between the handle lid 26 and the collar 20 could keep fluids from draining down the handle 4 into the cavity 24. Ring seals for restricting fluid flow as well as their use and manufacture are well known in the art. In other particular specific embodiments merely a disc-like cover 26 may be used to guide water away from the cavity 24. It is also contemplated that holes or slots (not shown) extending from the cavity 24 to the outer surface of the plunger base 5 may be used in place of a cover or seal to allow drainage of fluid out of the cavity 24. The holes or slots may also be used to ventilate or dry the brush 8 after use of the brush 8 to clean the toilet.

In particular embodiments of the present invention, the use of ventilation holes (not shown) may be incorporated into the plunger base 5 for letting fluid drain from the cavity 24 reducing the likelihood of retaining unsanitary fluids, and providing a more efficient manner of drying the brush after use. It will be understood that the cavity 24 may be ventilated by use of various sized through holes, slots or other shape extending from the outer surface of the plunger base 5 to the cavity 24, so long as the passage of fluid and air may be achieved.

Additionally, the brush 8 and handle 4, as shown if FIG. 3, may incorporate a removable or disposable brush 8. Brush 8 may be removed from handle 4 after use for scrubbing a toilet. The handle may then be attached to plunger base 5, as seen in FIG. 2, with or without brush 8 attached to handle 4. It will be understood that that the attachment of removable or disposable brush 8 may be by a clip, a threaded end, a manual catch and release mechanism or any other attaching devices that would enable a user to plunge and clean a toilet bowl using embodiments of the present invention. It is also contemplated that the plunger base of FIG. 2 may or may not include the cavity 24. In particular embodiments where the tool 2 does not have a cavity, the brush 8 and/or handle 4 may be coupled to plunger base 5 with the brush 8 visible or removed.

Figure 7:
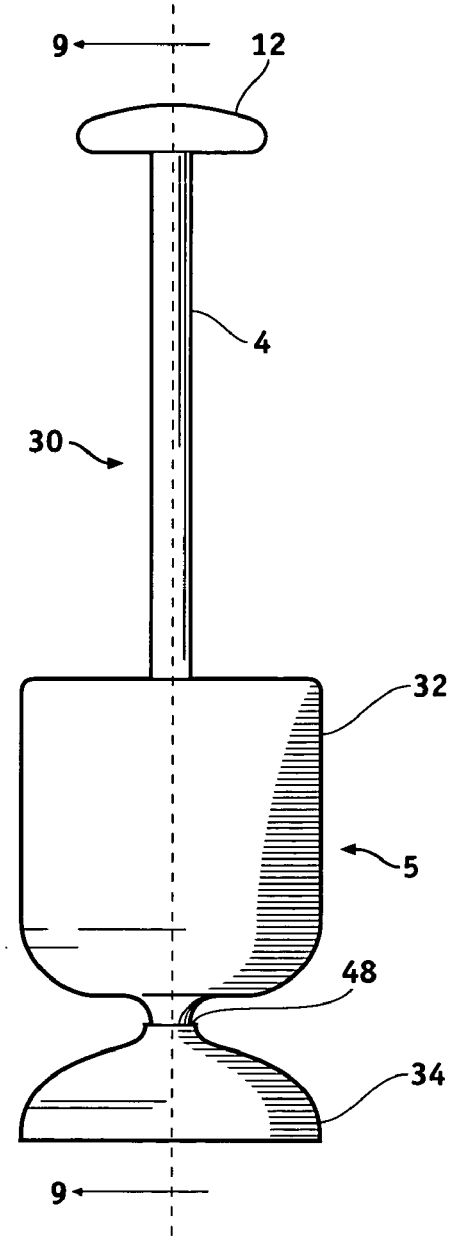
FIG. 7 is a front view of another exemplary embodiment combination plunger and brush with a removable plunger portion.
Figure 8:
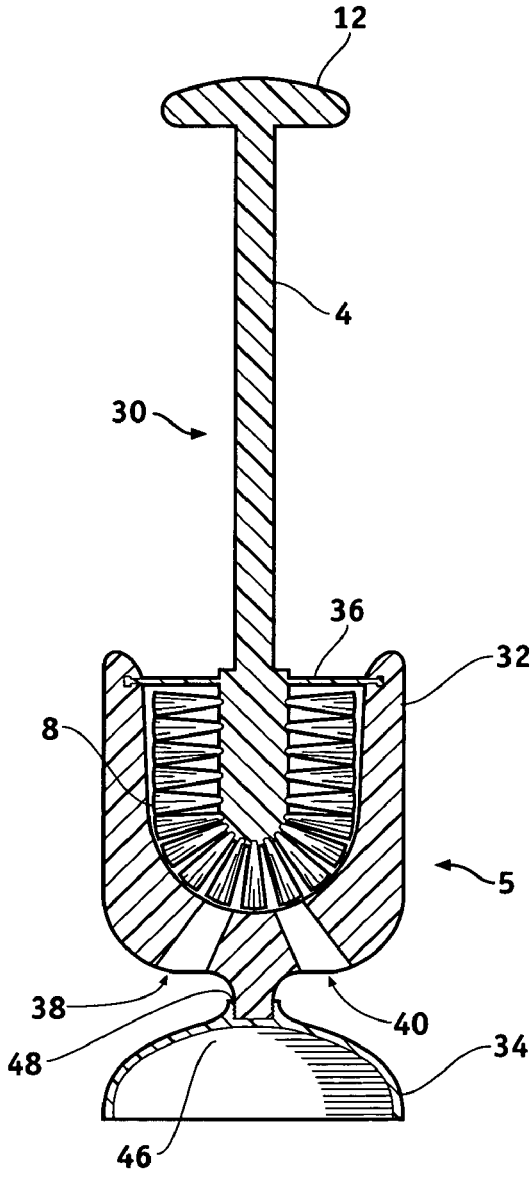
FIG. 8 is a section view taken along line 9-9 of FIG. 8 of a particular embodiment of the present invention.

FIGS. 7-8 illustrate another particular embodiment of a combination toilet plunger and toilet brush configured according to aspects of the present invention. The combination toilet brush and plunger tool 30 includes a handle 4 having a brush 8, a plunger base 5, including a brush receptacle 32 and a plunger 34, coupled to a first end of the handle 4 and a cross-member 12 coupled to a second end. Additionally, a coupling member 36 extends radially near the first end of the handle 4 above the brush 8.

Handle 4, brush 8, cross member 12, coupling member 36, and plunger 34 may be formed or manufactured in the same various manners, using the same variations of materials, configured in the same various configurations and for the same various uses as previously disclosed for the similar parts of other embodiments of the present invention. Brush receptacle 32 may be formed of any material and using any method conventionally used for forming a cleaning product receptacle, which maintains its shape and structural integrity. Examples of possible materials include, but are not limited to, plastic, wood, rubber, metal, and the like. Because plastic is easy to mold to a desired shape, cleans easily, is lightweight, and inexpensive, it is a particularly useful material for forming many cleaning product parts. However, parts of other materials may alternatively be used, and the particular material used is not crucial to this invention.

For the exemplary purpose of this disclosure, brush receptacle 32 may contain a cavity 46 configured to completely receive brush 8. Brush receptacle 32 may further be configured to have a plunger-coupling member 48 for coupling the brush receptacle 32 to plunger 34. It will be understood that plunger 34 may be a standard plunger that is interchangeable with various handles and is common in the art and may be coupled to the brush receptacle 32 by threading, press fit, adhesive or any other manner of coupling that will allow the function of plunging to occur. Additionally, the brush 8 and handle 4 may be connected to the brush receptacle 32 by way of an interlocking coupling member 16 extending from the first end of handle 4 and a top portion of brush receptacle 32. Coupling member 16 may be a plurality of pegs or posts in corresponding position with embedded groves, notches, and the like used individually or in combination and located on the top portion of brush receptacle 32. For convenience, a cross-member 12 is in place for twisting the handle 4 and brush 8 with the peg or posts in a sideways direction that will allow for the brush receptacle 32 to be interlocked with the brush handle 4 at the coupling member 36.

For both the embodiments shown in FIGS. 1-6 and the embodiments shown in FIGS. 7-8, the peg and slot connection example used for the coupling members is provided by example only and is not intended to be a limiting example.

Those of ordinary skill in the cleaning products art will readily understand that the particular structure used to couple the brush/handle portion to the plunger portion of the tool is not crucial to the invention and that there are many different types of suitable connections available. Additionally, the coupling members may be coupled to the handle in various locations on the handle and is not limited to only being coupled to the end of the handle.

When embodiments of the present invention are in use for plunging purposes, there is concern as to the displacement of water, particularly when the water level is very high within the toilet bowl. According to FIG. 8, brush receptacle 32 may also contain holes or vents 38 and 40 on the bottom portion of the brush receptacle 32. Holes or vents 38 and 40 allow for the free passage of fluid into and out of the cavity 46, thereby limiting the amount of fluid displacement during plunging. The holes 40 then allow the draining of cavity 46, thereby draining out the contaminated fluid and particles away from the brush 8 and the cavity 46 when plunging is complete. Additionally, a drip catch flange (not shown) may be coupled to the outer surface of plunger 34 to catch and hold fluid drainage through holes 38 and 40. The fluid to be caught is that fluid typically generated by using the brush 8 to clean the toilet and placing the brush 8 back into a stored position in brush receptacle 32.

Thus, according to all embodiments of the present invention the brush can be used separately from the plunger. The brush is conveniently stored attached to the base to which the plunger is attached. If the plunger is needed, the brush handle may be locked into the stand so that the handle of the brush is used as the handle for the plunger. While this may be accomplished, in particular embodiments, by twisting the handle to lock it into the stand, it may also be accomplished by adjusting latches, a press fit, and any other coupling means known in the art. When plunging is completed or not necessary, the user may access the brush by detaching it from the stand. The ability to use the tool for both plunging and for brushing, yet use the same storage space as is needed for only a typical plunger or brush is a great advantage. By enclosing the plunger in the decorative housing of the brush stand, the often offensive-looking toilet plunger can be attractively and functionally hidden.

Additionally, the invention may incorporate a telescoping, collapsing or folding handle or some other method by which the handle length may be reduced, altered or adjusted to make for compact storage or functional ease and use. The handle, brush and plunger may also be compacted, folded or incorporated onto itself or into a device or unit. Thus, it may have an attractive and compact appearance making it possible to store the device in an area that is functionally convenient. It will be understood that while the look and aesthetics of the tool may be that of typical brushes and plunger, a more thematic aesthetics capability is present. Such aesthetic appearance may be, but is not limited to a bell, a wand, a cane, a retracted umbrella, a baseball bat, or other such shape that may aid in the design and/or marketing of the invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the invention.

The invention claimed is:

1. A combination cleaning and plunging tool comprising:
a handle having a first end and a second end;
a brush coupled to the first end of the handle; and
a plunger base removably coupled to the first end of the handle, the plunger base comprising:
a resilient hollow plunger portion with an opening facing generally away from the second end of the handle; and
a brush receptacle having a cavity portion with an opening facing generally toward the second end of the handle, the brush receptacle sized and shaped to receive at least a portion of the brush therein when the handle is coupled to the plunger base;
wherein the brush receptacle comprises through holes extending from an outer surface of the brush receptacle to the cavity portion wherein the holes allow the passage of fluid into and out of the cavity portion of the brush receptacle.

2. The combination cleaning and plunging tool of claim 1, wherein the handle comprises a cross-member extending in at least one radial direction from the handle, the cross-member coupled to the second end of the handle.

3. The combination cleaning and plunging tool of claim 1, wherein the handle comprises a coupling member coupled to the first end of the handle for removably coupling the handle to the plunger base.

4. The combination cleaning and plunging tool of claim 3, wherein the plunger base further comprises a collar at the cavity portion of the plunger base, the collar configured to removably couple to the coupling member.

5. The combination cleaning and plunging tool of claim 1, wherein the brush comprises a plurality of brush bristles and a majority of the brush bristles are held within the cavity portion of the plunger base when the plunger base is coupled to the handle.

6. The combination cleaning and plunging tool of claim 1, further comprising a cover coupled to the first end of the handle, the cover sized and shaped so as to fill a substantial portion of the opening of the cavity.

7. The combination cleaning and plunging tool of claim 1, wherein the brush is a disposable brush portion wherein the disposable brush portion is removable from the handle and replaceable with an unused disposable brush portion.

8. The combination cleaning and plunging tool of claim 7, wherein the handle is coupled to the plunger base with and without the disposable brush portion attached to the handle.

9. The combination cleaning and plunging tool of claim 8, wherein the hollow portion of the plunger base rests on the ground and supports the brush and handle in a stored and substantially vertical position when the brush is coupled to the plunger base.

10. The combination cleaning and plunging tool of claim 1, wherein the brush is a toilet brush and the plunger base is a toilet plunger.

11. A combination cleaning and plunging tool comprising:
a handle having a first end and second end;
a brush coupled to the first end of the handle;
a plunger base removably coupled to the first end of the handle, the plunger base comprising:
a brush receptacle having a cavity portion with an opening facing generally toward the second end of the handle for receiving the brush;
a resilient plunger removably coupled to the brush receptacle and having a hollow portion facing generally away from the second end of the handle; and
wherein the brush receptacle comprises through holes extending from an outer surface of the brush receptacle to the cavity portion wherein the holes allow the passage of fluid into and out of the cavity portion of the brush receptacle.

12. The combination cleaning and plunging tool of claim 11, wherein the handle further comprises a cross-member extending in at least one radial direction from the handle, the cross-member coupled to the second end of the handle.

13. The combination cleaning and plunging tool of claim 11, wherein the handle further comprises a coupling member coupled to the first end of the handle for removably coupling to the brush receptacle.

14. The combination cleaning and plunging tool of claim 13, wherein the brush receptacle is configured to removably couple to the coupling member.

15. The combination cleaning and plunging tool of claim 11, wherein the brush comprises a plurality of brush bristles and a majority of the brush bristles are held within the cavity portion of the brush receptacle when the plunger base is coupled to the handle.

16. The combination cleaning and plunging tool of claim 11, further comprising a cover coupled to the first end of the handle, the cover sized and shaped so as to fill a substantial portion of the opening of the cavity of the brush receptacle.

17. The combination cleaning and plunging tool of claim 11, wherein the brush is a toilet brush and the plunger is a toilet plunger.

18. The combination cleaning and plunging tool of claim 11, further comprising a cover coupled to the first end of the handle, the cover sized and shaped so as to fill a substantial portion of the opening of the cavity.

19. The combination cleaning and plunging tool of claim 11, wherein the brush is a disposable brush portion wherein the disposable brush portion is removable from the handle and replaceable with an unused disposable brush portion.

20. The combination cleaning and plunging tool of claim 19, wherein the hollow portion of the resilient plunger rests on the ground and supports the brush and handle in a stored and substantially vertical position when the brush is coupled to the resilient plunger.

* * * * *